US011123787B2

(12) United States Patent
Cisar

(10) Patent No.: US 11,123,787 B2
(45) Date of Patent: Sep. 21, 2021

(54) TRANSPORT DEVICE FOR PRESS LINES AND METHOD FOR CONTROLLING SUCH A TRANSPORT DEVICE

(71) Applicant: Schuler Pressen GmbH, Goppingen (DE)

(72) Inventor: Rolf Cisar, Engelthal (DE)

(73) Assignee: SCHULER PRESSEN GMBH, Goppingen (DE)

( * ) Notice: Subject to any disclaimer, the term of this patent is extended or adjusted under 35 U.S.C. 154(b) by 280 days.

(21) Appl. No.: 16/308,058

(22) PCT Filed: May 5, 2017

(86) PCT No.: PCT/EP2017/060820
§ 371 (c)(1),
(2) Date: Dec. 7, 2018

(87) PCT Pub. No.: WO2017/211512
PCT Pub. Date: Dec. 14, 2017

(65) Prior Publication Data

US 2019/0308237 A1 Oct. 10, 2019

(30) Foreign Application Priority Data

Jun. 7, 2016 (DE) ..... 102016110491.4

(51) Int. Cl.
*B21D 43/05* (2006.01)

(52) U.S. Cl.
CPC ..... *B21D 43/055* (2013.01); *B21D 43/057* (2013.01)

(58) Field of Classification Search
CPC ..... B65G 25/00; B21D 43/10; B21D 43/11; B21D 43/057; B21D 43/05; B21D 43/055
See application file for complete search history.

(56) References Cited

U.S. PATENT DOCUMENTS 5,452,981 A 9/1995 Crorey et al.
6,196,044 B1 * 3/2001 Sofy ..... B21D 43/05 72/405.01

(Continued)

FOREIGN PATENT DOCUMENTS

DE 2746048 A1 4/1979
DE 19506079 A1 8/1996

(Continued)

OTHER PUBLICATIONS

Norbert, Translation of DE10348643 (Year: 2005).*

(Continued)

*Primary Examiner* — Adam J Eiseman
*Assistant Examiner* — Bobby Yeonjin Kim
(74) *Attorney, Agent, or Firm* — Hoffmann & Baron, LLP

(57) ABSTRACT

A transport device for the transport of workpieces in a workpiece transport direction in a press, which has a carrier rail, which is mounted, via a lifting carriage and a rocker rotatably mounted on the lifting carriage, on a vertically running upright of the press. In order to enable a flexible workpiece transport, it is provided that, on the carrier rail, workpiece grippers are mounted on at least two transport carriages, which each have their own drive mechanism in order to move the transport carriages with the workpiece grippers along the carrier rail independently of each other.

19 Claims, 7 Drawing Sheets

(56) References Cited

U.S. PATENT DOCUMENTS

| | | | | |
|---|---|---|---|---|
| 2005/0227840 | A1* | 10/2005 | Cisar | B21D 43/057 483/14 |
| 2007/0051157 | A1 | 3/2007 | Shiroza | |
| 2015/0298198 | A1* | 10/2015 | Cisar | B23K 37/047 29/428 |

FOREIGN PATENT DOCUMENTS

| | | | | | |
|---|---|---|---|---|---|
| DE | 19515606 | A1 | | 10/1996 | |
| DE | 19605159 | A1 | | 8/1997 | |
| DE | 19645792 | A1 | * | 5/1998 | B21D 43/055 |
| DE | 19645792 | A1 | | 5/1998 | |
| DE | 10310941 | A1 | | 10/2004 | |
| DE | 10348643 | | * | 5/2005 | B21D 43/05 |
| DE | 10348643 | B3 | * | 5/2005 | B21D 43/055 |
| DE | 10348643 | B3 | | 5/2005 | |
| DE | 102007051037 | B3 | | 1/2009 | |
| JP | S62118633 | U | | 7/1987 | |
| JP | H01143731 | A | | 6/1989 | |
| KR | 20150004609 | | | 12/2015 | |

OTHER PUBLICATIONS

Blau, Translation of DE-10348643 (Year: 2005).*
Zschocher, Translation of DE-19645792 (Year: 1998).*
German Report from corresponding German Patent Application No. 10 2016 110 491.4, pp. 1-6 (dated Feb. 23, 2017).
International Search Report for corresponding PCT Application No. PCT/EP2017/060820, pp. 1-6 (dated Apr. 12, 2017).

* cited by examiner

TRANSPORT DEVICE FOR PRESS LINES AND METHOD FOR CONTROLLING SUCH A TRANSPORT DEVICE

This application claims priority based on an International Application filed under the Patent Cooperation Treaty, PCT/EP2017/060820, filed on May 5, 2017, and German Application No. 10 2016 110 491.4, filed on Jun. 7, 2017.

BACKGROUND OF THE INVENTION

The invention relates to a transport device for transporting workpieces in a forming machine or press line in the workpiece transport direction, according to the features of the preamble of claim 1.

Such a device for transporting workpieces is known from DE 103 48 643 B3. This transport mechanism has two parallel carrier rails on which are arranged carriages with tool grippers for transporting workpieces. These carriages are connected to each other and are driven by a common drive unit, which has a spindle drive. The carrier rails are mounted on vertical press uprights. For this purpose, two vertically movable carriages are provided on each press upright, which are connected to the carrier rail via a lever mechanism. Via the lever mechanism, the carrier rail can be actuated within the press in the lifting and/or clamping direction.

From DE 195 06 079 A1 a workpiece transport device is known with the aid of which workpieces can be transported in a press. This device has two parallel carrier rails which are arranged on a clamping box. The clamping box is arranged on the floor of the press and has a lift and a clamping drive in order to move the transfer rails. Individual workpiece grippers are arranged on the carrier rails, which have a linear motor and can be moved along the carrier rail.

A disadvantage of the known state of the art is that the transport devices impede access to the press since these are arranged either in the input or output window of a press or occupy part of the lateral gate area of the press. The window available for the tool transport and/or the workpiece transport, which serves as access to the working area of a press, is thereby spatially restricted.

SUMMARY OF THE INVENTION

The object of the invention is to create a transport device for a press line or forming machine which has a low space requirement and, in particular, encroaches as little as possible on the press window or lateral gate areas available for the workpiece transport or tool transport. The transport device is to be constructed to be mechanically stable and to enable a flexible workpiece transport.

This object is achieved according to the invention by a transport device with the features of claim 1, a transport device with the features of claim 7 and a method for controlling a transport device with the features of claim 33.

It is provided, according to the invention, that the transport device has a carrier rail running in the workpiece transport direction, wherein this is mounted on a vertically running upright in the area of its ends each, via a lifting carriage displaceably driven in the vertical direction by a lift drive. The lifting carriage has a rocker, which the lifting device mounts rotatably. The rocker is connected at its end to the carrier rail. The invention provides that, on the carrier rail, at least two transport carriages each having a workpiece gripper are mounted, wherein each transport carriage has its own drive mechanism, in order to move this transport carriage in a driven manner along the carrier rail independently of other transport carriages.

This type of mounting of the at least one carrier rail on the vertical uprights enables a universal transport of workpieces accompanied by a very low space requirement of the transport device. The lifting carriages occupy only a little space and can additionally be moved in the vertical direction in order to free up the access to a working area of the press line or forming machine. It is not necessary to support the carrier rail via a frame standing on a press base or a floor.

The transport device can be formed as a monotransfer, this means the transport device has only one single carrier rail. In an alternative design, the transport device can also have more than one carrier rail. In one design, the transport device can preferably have two transport rails running in the workpiece transport direction. These can be arranged running parallel to each other. The carrier rails can preferably be arranged spaced apart from each other transverse to the transport direction.

The workpieces can be transported on the carrier rails both in the workpiece transport direction and also contrary to the workpiece transport direction via the individually driven transport carriages. A separate longitudinal drive for the carrier rails can thereby be omitted. Such a longitudinal drive is provided in the case of conventional transport systems, in order to drive the carrier rails together with the workpieces in the workpiece transport direction. In known systems, such a longitudinal drive is arranged before or after a press bed in the workpiece transport direction and occupies part of the press window due to its size. Because such a longitudinal drive can be omitted in the solution according to the invention, a larger press window is available for the workpiece transport.

Through the individual actuation of individual transport carriages, individual workpieces each with their own movement profile can be transported at the same time with the transport device. A movement profile can comprise different parameters such as, for example, speeds and/or accelerations and/or time-dependent changes in speed and/or times, e.g. transport times and/or residence times, and/or stroke lengths and/or transport paths. For example, several workpieces each with different movement profiles can be transported at the same time. For example, one workpiece can remain stationary and be processed while a second workpiece is transported. Alternatively, two workpieces can be transported in opposite directions, that is towards one another.

The transport device can be used together with a press line or a forming machine or a handling system or a stacking system in order to transport workpieces in the systems.

In one design, it is further provided that a gate area is arranged to the side of a processing area, for example a pressing area or forming area. The gate area is bordered by two vertical uprights each. The vertical uprights of a gate area are spaced apart from each other in the workpiece transport direction. The gate area extends between the uprights over the entire distance between the vertical uprights in the workpiece transport direction.

According to one design of the invention it is provided that the length of the carrier rail is shorter than the distance between the uprights in the workpiece transport direction and the rocker is rotatably mounted on the lifting carriage in such a way that the carrier rail can be pivoted out of the pressing area or forming area in that the rocker can be pivoted between the vertical uprights into the gate area or through the gate area. It is thus made possible that the carrier rail or several carrier rails can be moved out of the processing area, preferably out of the pressing area or forming area, in the lateral direction, i.e. transverse to the workpiece transport direction. It is thereby prevented, for example when working in the pressing area, that the transport device or the carrier rails interfere with this work. It is further advantageously made possible that work on the carrier rails or on workpiece grippers can be carried out not within the pressing area but outside the pressing area.

With this design, the carrier rail can be formed in an embodiment without transport carriages. This means that one or more workpiece grippers are held directly on the carrier rail or on a corresponding workpiece gripper holder of the carrier rail. Alternatively, the carrier rail can have a transport carriage with a workpiece gripper. The transport carriage can be moved along the transport rail in a driven manner. In an advantageous design, the carrier rail can have several transport carriages, which are mounted movable on the carrier rail and can be moved along the carrier rail in a driven manner. In particular, at least two transport carriages each having one workpiece gripper can be mounted on the carrier rail, wherein each transport carriage has its own drive mechanism, in order to move this transport carriage in a driven manner along the carrier rail independently of other transport carriages.

Pressing area denotes that area which is arranged between the press uprights and in which tools, such as for example a press die, driven by a press line or forming machine work. The gate area adjoins the pressing area at the side. The gate area extends over the entire width of the vertical uprights. By pivoting the carrier rail into the gate area is also meant a position of the carrier rail in which the carrier rail itself is not yet arranged between the vertical uprights but the rocker runs essentially parallel to the vertical upright. This means, when the carrier rail is in the gate area, the rocker is, relative to the upright, within an angular range of 0° (the rocker is parallel to the vertical upright) to 10°, preferably less than 15°, most preferably less than 22°.

By means of a press line or forming machine, workpieces, in particular panel-shaped workpieces consisting of metal or plastic or fibre material or composite materials, can be processed, such as for example body panels of a motor vehicle.

In an advantageous design, it can be provided that the carrier rails are formed as profiles or carrier beams on which transport carriages are mounted movable in the longitudinal direction. A transport carriage can have a holder on which one or more workpiece grippers are held detachably. Further, a transport carriage can comprise a drive mechanism which is arranged on the carrier rail. The drive mechanism acts between the carrier rail and the transport carriage in order to move the transport carriage relative to the carrier rail.

In particular, the carrier rails run parallel to each other in the workpiece transport direction. It can further be provided that the transport rails are only mounted on the vertical uprights. A supplementary support of the transport rails, for example through a frame supporting the transport rails, is not necessary. This means that the space which is normally needed in the state of the art for such a frame is no longer required in the solution according to the invention and thus more space is available for transporting or processing workpieces.

A particularly flexible control of the workpieces can be made possible in one design in that the drive mechanisms of the transport carriages are connected to a workpiece control device in such a way that, through the workpiece control device, a drive mechanism of a transport carriage can be actuated individually in that the workpiece control device defines or controls a movement profile of a transport carriage. A movement profile can comprise different parameters such as, for example, speeds and/or accelerations and/or time-dependent changes in speed and/or times, e.g. transport times and/or residence times, and/or stroke lengths and/or transport paths. For example, the workpiece control device can define a speed and a drive direction of the drive device. It is thus possible to actuate each individual drive device or an individual transport carriage individually. This means that the speed and/or the direction of travel thereof can be controlled individually independently of other transport carriages.

In order to improve the precision of the control, in one design it can be provided that the carrier rail has a path measuring device connected to the workpiece control device. The path measuring device is, in particular, formed to determine a position of a transport carriage and/or of a workpiece gripper relative to the carrier rail and to transmit the position to the drive mechanism of the transport carriage and/or the workpiece control device.

In an economical and space-saving design it can be provided that a drive mechanism of the transport carriages has an electric linear motor. Alternatively, several drive mechanisms of the transport carriages can each have an electric linear motor. The transport carriage can each have a rotor of a linear motor and a stator of the linear motor can be arranged on the carrier rail, or vice versa. Preferably all the transport carriages have an electric linear motor. The rotor of an electric linear motor can, for example, be formed as a magnetic plate which is arranged on the carrier carriage. The magnetic plate can have one or more permanent magnets or generate a magnetic field via an electromagnet. The stator arranged on the carrier rail can, in particular, comprise several windings of a coil which can be actuated individually in order to accurately control the magnetic fields of the stator. Through the interaction of the magnetic fields generated by the stator and the magnetic field of a rotor, a force acts on the rotor which moves the rotor and thus a transport carriage linearly along the stator.

In an alternative design, the transport carriages can each have a linear motor which co-operates with a toothed rack via a pinion. The toothed rack can be arranged on the transport rail and the pinion with a drive motor can be arranged on the transport carriage or connected to the transport carriage. Drives with servomotors and/or toothed belts or spindle drives can also be arranged on the transport carriage or connected to the transport carriage in order to drive the transport carriage along a transport rail.

In an advantageous design, it can be provided that the lifting carriage of a carrier rail has a rotary drive for rotating the rocker connected to the carrier rail. Preferably, the rotary drive can have an electric motor with a rotary output which co-operates with a carriage-side pivot bearing for rotating the rocker. By integrating a rotary drive, in particular an electric motor with a rotary output, into the lifting carriage, a compact design of the rotary drive of the carrier rails is made possible. The rotary drive can, for example, have an electric servomotor or a stepper motor, in order to accurately control or regulate the pivot angle of the rocker.

In particular, it is provided that the lifting carriage is formed in one piece. This means that the lifting carriage has only one single carriage bracket which is movable on a vertical upright.

In one design, it can be provided that the rocker has a single rocker arm connecting the carrier rail to the lifting carriage, wherein the rocker arm is pivotably connected to the carrier rail. Through the pivotable mounting of the carrier rail, the latter can always be aligned in a defined manner independently of an angle of rotation of the rocker arm. This means the inclination of the carrier rail relative to the vertical can be set. The rocker arm can be formed as a solid profile or as a grid profile. To reduce weight, it can also be provided that the rocker arm has material-free areas.

In an alternative design, it can also be provided that the rocker has a parallelogram linkage with two rocker arms, which are each rotatably mounted with one of their ends on the same lifting carriage and, with their other end, are pivotably connected to the carrier rail. A rotational movement of the rocker in the area of the lifting carriage can thereby be converted into an approximately linear movement in the area of the carrier rail. The two rocker arms are designed as separate retaining arms. This means the rocker arms are not directly connected to each other. The ends of these two rocker arms are each secured or mounted, at one end, on a lifting carriage and, at the other end, on a carrier rail or a connection device of the carrier rail. A relative movement between the two rocker arms is thereby made possible. Via such a relative movement, the inclination of the carrier rail relative to the vertical can be controlled, for example. In particular, it can be provided that the lifting carriage has two separate pivot bearings, wherein one pivot bearing is connected to one rocker arm each. The lifting carriage can also have a rotary drive motor with a rotary output, which is connected to one of the pivot bearings, in order to drive the rocker. Alternatively, the rotary output can be connected to one or to both pivot bearings via a gear drive or a belt drive in order to drive the rocker. It can also be provided that the lifting carriage has two rotary drive motors, wherein each rotary drive motor co-operates with one pivot bearing in order to drive one retaining arm each.

In one design, it is preferably provided that the lifting carriage has two rotary drive motors, wherein each rotary drive motor co-operates with one pivot bearing in order to drive one retaining arm each.

In order to enable a simple assembly of the carrier rails, in one design it can be provided that the rocker has, on its end connected to the carrier rail, a bracket for the detachable connection of the carrier rail. The bracket can have a detachable mechanical connection and a detachable electrical connection. A detachable pneumatic connection and/or a detachable hydraulic connection is also conceivable. The mechanical connection can, for example, comprise a screw connection or a catch mechanism in order to connect the rocker to the carrier rail detachably. The electrical connection of the bracket can be formed as an electrical plug connection or as a screw connection.

In order to enable a precise positioning of a carrier rail, in one design it can be provided that the rocker has a pivot drive, which pivots the carrier rail and/or the bracket relative to the rocker in order to set a particular angle between the carrier rail and the rocker. The pivot drive can, for example, have an electric servomotor or a stepper motor in order to pivot the carrier rail by a particular angle or to set a particular angle between carrier rail and rocker. Via the pivot drive, the inclination of the carrier rail relative to the vertical can be controlled.

In order to improve the workpiece transport or to be able to increase the speed of the workpiece transport, in one design it can be provided that, on the end connected to the carrier rail, preferably at the bracket, the rocker has a longitudinal drive in order to move the carrier rail in the workpiece transport direction. Via the longitudinal drive, the carrier rail can be moved relative to the rocker in the workpiece transport direction. The longitudinal drive is arranged on the rocker in the area of the connection of the carrier rail. It is advantageous that the longitudinal drive can be pivoted together with the carrier rail via the rocker. This has the advantage that the longitudinal drive can be pivoted out of the pressing area together with the carrier rail and the longitudinal drive does not spatially restrict the lateral gate area or the press window.

The longitudinal drive can, for example, be designed as a spindle drive or as a toothed belt drive. Alternatively, the longitudinal drive can also have a rotary motor, the output of which is a cog wheel, which co-operates with a toothed rack. In an alternative design, it can also be provided that the longitudinal drive is formed as an electric linear motor, wherein the stator is arranged on the rocker and the rotor is arranged on the carrier rail, or that the rotor is arranged on the rocker and the stator is arranged on the carrier rail.

In one design, the longitudinal drive can be provided as the only drive, in order to move the carrier rails in the workpiece transport direction. This means the longitudinal drive can be combined with carrier rails on which workpiece grippers are fixed in place.

In another design, the longitudinal drive can be combined with such carrier rails in which at least two transport carriages each having one workpiece gripper are mounted on one carrier rail, wherein each transport carriage has its own drive mechanism in order to move this transport carriage in a driven manner along the carrier rail independently of other transport carriages. In this design, either individual transport carriages can be moved in the tool transport direction or a carrier rail can be moved in the tool transport direction or, at the same time, a transport carriage or several transport carriages and the carrier rail can be moved in the tool transport direction.

In order to achieve a compact design, it can be provided that the lift drive of the lifting carriage is formed as a linear motor, preferably as an electric linear motor.

In order also to be able to absorb high mechanical forces via the transport device, in one design it can be provided that the lifting carriage or the lift drive of the lifting carriage has a switchable locking mechanism in order to fix the lifting carriage in a vertical position on the upright. The locking mechanism can, for example, comprise a bolt which can be moved via a solenoid, which fixes the lifting carriage on the vertical upright in that the bolt engages in a recess. Alternatively, the locking mechanism can comprise a clamp which can be switched via an electromagnet, which clamps the lifting carriage in a vertical position on the upright. Alternatively, hydraulic or pneumatic locking mechanisms can also be provided in order to fix the lifting carriage in a vertical position on an upright.

In order to make possible a precise control of the transport device, it can be provided that the lift drive and the rotary drive of a lifting carriage are connected to a control device and the control device actuates both the lift drive and the rotary drive for performing a lifting movement and/or a clamping movement of a carrier rail. The transport device can have its own control device. Alternatively, the control device can also be integrated into the press line or a control for the press line, however.

In particular, it is provided that the longitudinal drive of a support bar is connected to the control device and the control device actuates the longitudinal drive for moving the support bar in the workpiece transport direction or contrary to the workpiece transport direction, in order to transport workpieces. The vertical uprights can be formed as carrier beams or formed as part of a framework or a frame, which is connected to the press. In particular, it is provided that the press uprights are connected to each other at their upper end via a press cross-head. The press cross-head can serve at the same time for carrying a press die.

In one design, it can be provided that the lift drive and the rotary drive and the pivot drive of a lifting carriage are connected to a control device and the control device actuates the lift drive as well as the rotary drive and the pivot drive for performing a lifting movement and/or a clamping movement of a carrier rail. Lifting movement describes a movement along the vertical. Clamping movement describes a movement transverse to the workpiece transport direction, preferably a horizontal movement.

In an alternative design, it can be provided that the longitudinal drive of a support bar is connected to the control device and the control device actuates the longitudinal drive for moving the support bar in the workpiece transport direction or contrary to the workpiece transport direction, in order to transport workpieces. Preferably it can be provided that the lifting carriages are arranged in the lateral gate area, wherein one lifting carriage is mounted on a vertical upright each in such a way that the lifting carriages are directly opposite each other, in particular that the lifting carriages are arranged on the directly opposite ends of the two vertical uprights.

In order to enable a space-saving arrangement of the carrier rails, in one design it can be provided that the lifting carriage and the rocker are formed and arranged in such a way that the rocker can be rotated by the rotary drive of the lifting carriage into a position in which the rocker runs parallel to the vertical upright.

The transport device according to the invention can be used in a press line or forming machine in order to carry out workpiece transport. It is provided that the press line or forming machine has a press bed which is arranged between four press uprights. Two of the press uprights each are arranged on the same side of the press bed spaced apart from each other in the workpiece transport direction. Between these two press uprights, that is to the side of the pressing area, a gate area of the press is arranged. Through this gate area, work can be carried out on the press or on the pressing tool. In the workpiece transport direction, the press line has an input window and an output window in order to transfer raw material or workpieces into the press or to discharge them from the press. The input window and the output window are likewise bordered by two vertical press uprights, specifically the uprights which are arranged either before the press bed or after the press bed in the workpiece transport direction.

It is provided that the transport device according to the invention can be used for modifying or retrofitting an existing press line or forming machine. For this purpose, it is provided that, in a first step, an existing transport mechanism is removed from the press line or forming machine then, in a next step, a linear drive and a lifting carriage are each secured to the press uprights with a rocker of the transport mechanism and subsequently a carrier rail is connected to the ends of two rockers lying on the same side of the workpiece transport direction.

In controlling the transport device, it is provided that a lifting movement of the transport device takes place in that the lifting carriages are moved in the vertical direction via the lift drives on the press uprights.

A clamping movement of the transport device takes place in that the rotary drives of the lifting carriages of a carrier rail and, at the same time, the lift drives of the same lifting carriages are actuated in such a way that the carrier rail is moved in the horizontal direction by the rotary drives and, at the same time, the vertical movement of the carrier rail caused by the rotational movement is compensated by the lift drives. It is thus made possible that a clamping movement, i.e. a movement transverse to the workpiece transport direction, can be performed, without a vertical movement of the workpiece taking place.

In one design of the transport device according to the invention it is provided that the latter is controlled in such a way that a lifting movement of the transport device takes place in that the lifting carriages are moved in the vertical direction via the lift drives on the press uprights and that a clamping movement of the transport device takes place in that the rotary drives of the lifting carriages of a carrier rail and the lift drives of the same lifting carriages are actuated in such a way that the carrier rail is moved in the horizontal direction by the rotary drives and, at the same time, the vertical movement of the carrier rail caused by the rotational movement is compensated by the lift drives.

In order to manufacture a workpiece consisting of two individual workpieces or in order to process two workpieces at the same time, in a pressing station or press line it can be provided that, for transferring further raw material or a second workpiece, at least one carrier rail and at least one transport carriage of this carrier rail are moved in the workpiece transport direction and, in the area of the output window, the further raw material or a second workpiece is received via the workpiece gripper of the transport carriage.

In order to discharge a finished workpiece from the press line, it can be provided that, for discharging a workpiece, at least one carrier rail and at least one transport carriage of this carrier rail are moved in the workpiece transport direction and, in the area of the output window, the workpiece is discharged.

In one design it can be provided that a modification of a pressing tool takes place in that a carrier rail is pivoted via the rotary drives of the assigned lifting carriages into or out of the lateral gate area, in that the rockers of the carriages are placed parallel to the press uprights, or in that the carrier rail is pivoted via the rotary drives through the gate area and subsequently the carrier rail is moved upwards or downwards out of the lateral gate area or at least to the edge of the gate area by moving the lifting carriages in the vertical direction. The carrier rail is thereby moved out of the pressing area and also out of the lateral gate area. As a result, this means that neither the gate area nor the pressing area is spatially impeded by the transport device or the carrier rails thereof. The maximum possible space is therefore available for press-line modification of a tool of the press.

In order to enable simple maintenance or repair or modification of the transport device, it can be provided that, for modifying workpiece grippers of a carrier rail, these are pivoted via the rotary drives of the assigned lifting carriages into the gate area or through the gate area. It is provided that the carrier rail is subsequently pivoted into a working position by the pivot drives of the rockers for changing the tool grippers, preferably that the carrier rail is pivoted in the working position into a vertically or horizontally aligned position. In the vertically or horizontally aligned position of the carrier rail, a tool can then be exchanged easily outside the press. Alternatively, maintenance on the carrier rail or on the workpiece grippers can also be carried out.

BRIEF DESCRIPTION OF THE DRAWINGS

Further advantageous designs of the invention are shown in the figures and described in the following description of the figures.

There are shown in.

DETAILED DESCRIPTION OF THE INVENTION

In FIGS. 1 to 6*b* different embodiments of the invention are represented. Essentially, the structures of the individual designs agree. Differences between the embodiments are explained in each case in the description of the figures. The same components are, in each case, provided with the same reference numbers.

Figure 1A:
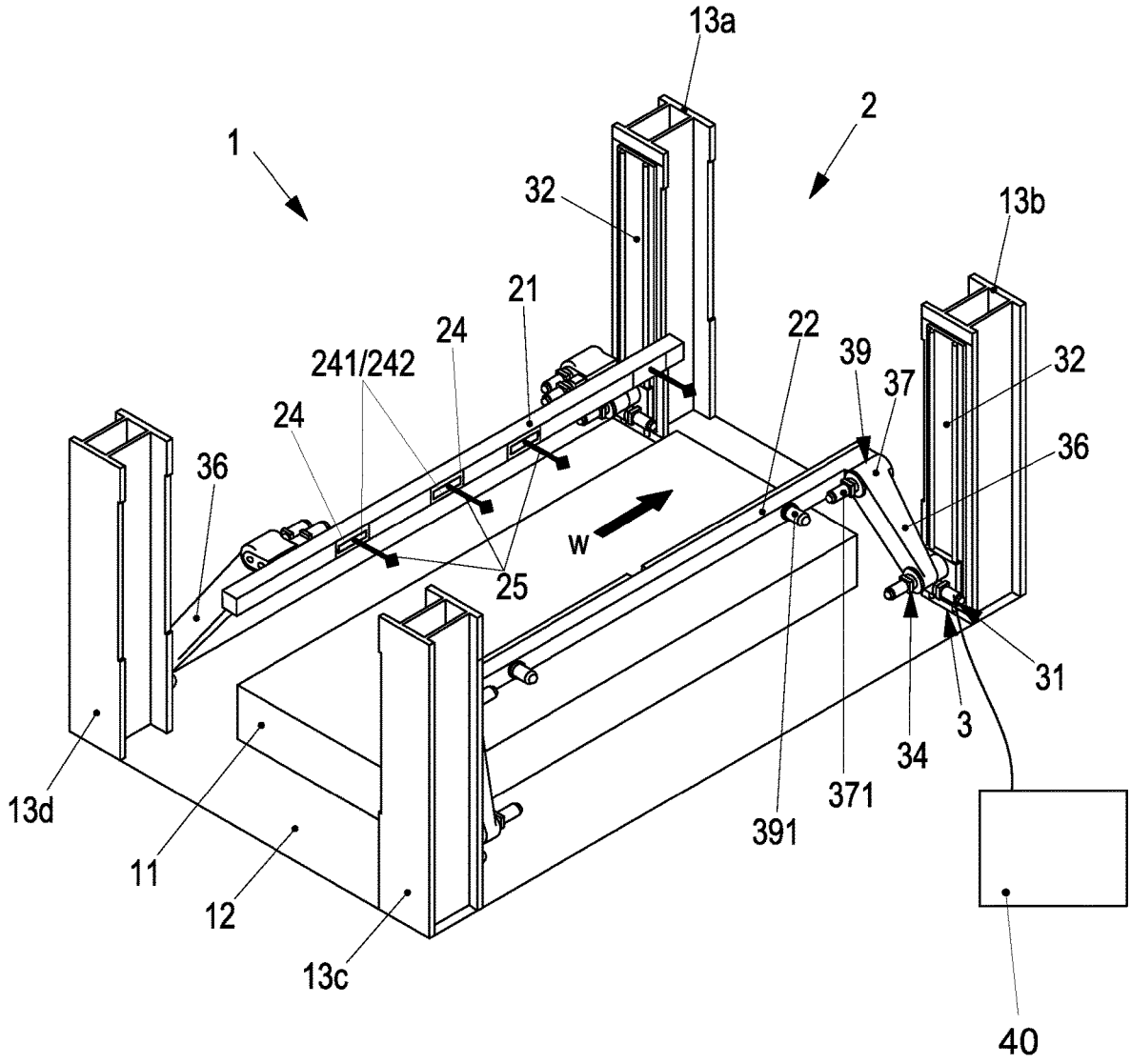
FIGS. 1*a*, 1*b*: the transport device with a press line.
Figure 1B:
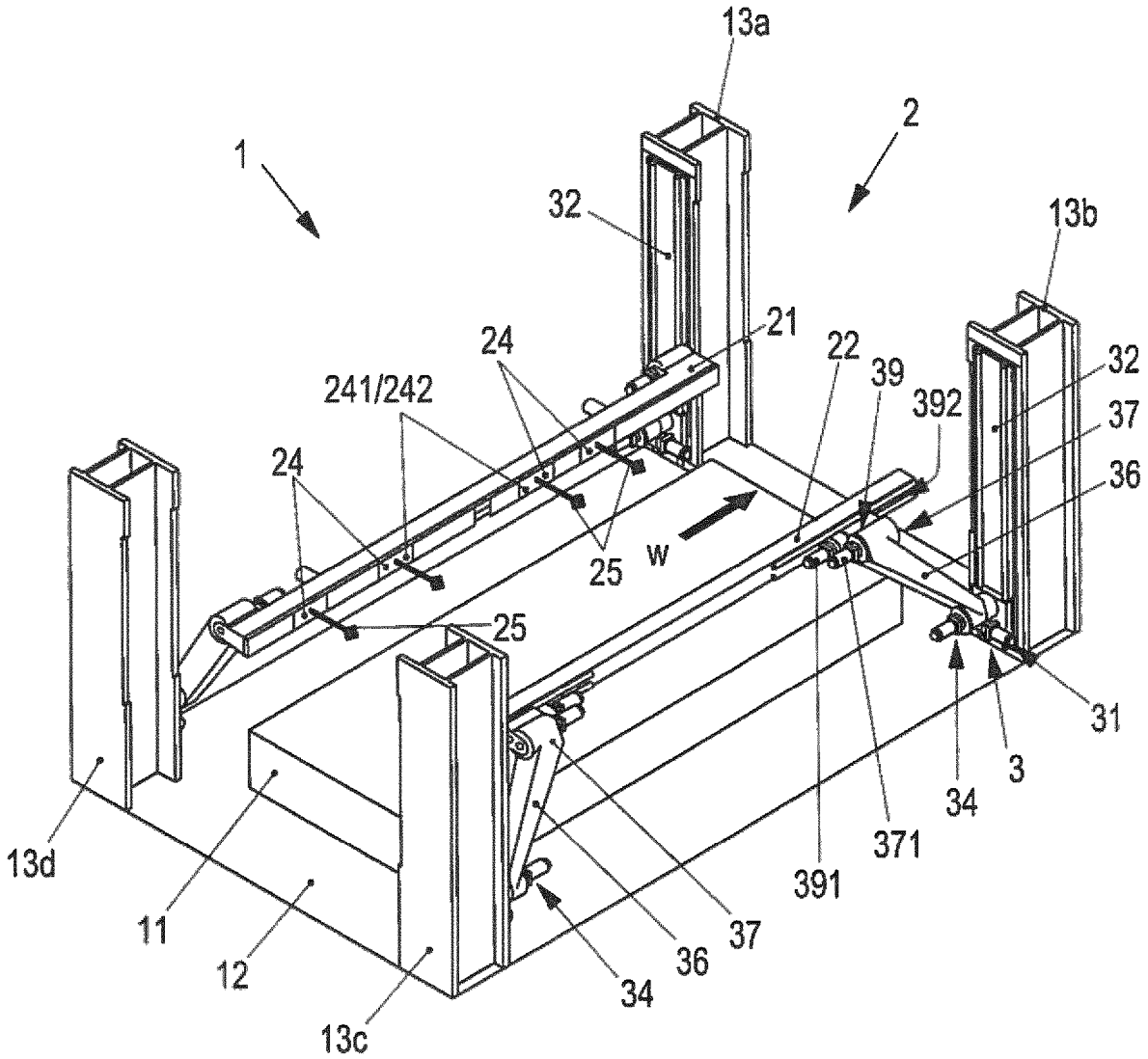

In FIGS. 1*a* and 1*b*, a press line (or forming machine) 1 is shown. The press line 1 has a transport device 2 in order to transport workpieces in the workpiece transport direction W. The press line 1 has a press base 12 at the bottom on which a press bed 11 is arranged. The press bed 11 is arranged in the centre of the working area of the press. The press line 1 has four vertically running press uprights 13*a*, 13*b*, 13*c* and 13*d*. The press uprights 13*a* to 13*d* are formed as supporting profiles and arranged in the area of the corners of the press base. The press uprights stand on the base 12 of the press line 1 and support a press cross-head. A press die with a pressing tool is secured to the press cross-head. In the figures, for the purposes of better clarity, the press cross-head with the press die and the pressing tool is not shown.

The transport device 2 has two carrier rails 21 and 22 running in the workpiece transport direction. Each carrier rail 21 or 22 is mounted, in the area of their ends, on a vertical press upright 13*a* to 13*d* by means of a rocker 36 and a lifting carriage 3.

Several transport carriages 24 are arranged on each carrier rail 21 or 22. The transport carriages 24 can be moved relative to the carrier rail 21 or 22. For this purpose, the transport carriages 24 each have a drive mechanism 241 which has an electric linear motor 242 in order to move the transport carriages 24 along the carrier rail 21 or 22 in a driven manner. The drive mechanisms 241 can be actuated selectively via a control device 40, i.e. each transport carriage can be actuated or moved independently. The transport carriages 24 each have a tool gripper 25. The tool grippers 25 are each detachably mounted on a transport carriage and can be exchanged easily. With the aid of the tool grippers, individual workpieces can be received and subsequently processed in the press. After the processing procedure, the workpiece is transported out of the pressing area and transferred to the next processing station.

The two carrier rails 21 and 22 are each connected to lifting carriages 3 via rockers 36. The lifting carriages 3 have a lifting bracket, which is secured to a vertically running rail 32. The vertically running rail 32 is each connected to a vertical press upright 13*a* to 13*d*. The lifting carriage 3 can be moved in the vertical direction, i.e. up or down, on the vertical press upright 13*a* to 13*d* via a lift drive 31. In this movement, the respective carrier rail 21 or 22 is carried along with the result that the carrier rail can be adjusted in the vertical direction via the lifting carriage 3. The lifting carriage 3 has a lifting motor 33, which acts between the lifting carriage and lift rail, in order to move the lifting carriage along the rail 32. The lifting motor 33 can be formed as an electric servomotor, or as a stepper motor or as an electric linear motor.

In order also to be able to absorb high mechanical forces via the transport device, in one design, as shown in FIG. 31, it can be provided that the lifting carriage or the lift drive of the lifting carriage has a switchable locking mechanism 41 in order to fix the lifting carriage in a vertical position on the upright. The locking mechanism can, for example, comprise a bolt which can be moved via a solenoid, which fixes the lifting carriage on the vertical upright in that the bolt engages in a recess. Alternatively, the locking mechanism can comprise a clamp which can be switched via an electromagnet, which clamps the lifting carriage in a vertical position on the upright. Alternatively, hydraulic or pneumatic locking mechanisms can also be provided in order to fix the lifting carriage in a vertical position on an upright.

Figure 5:
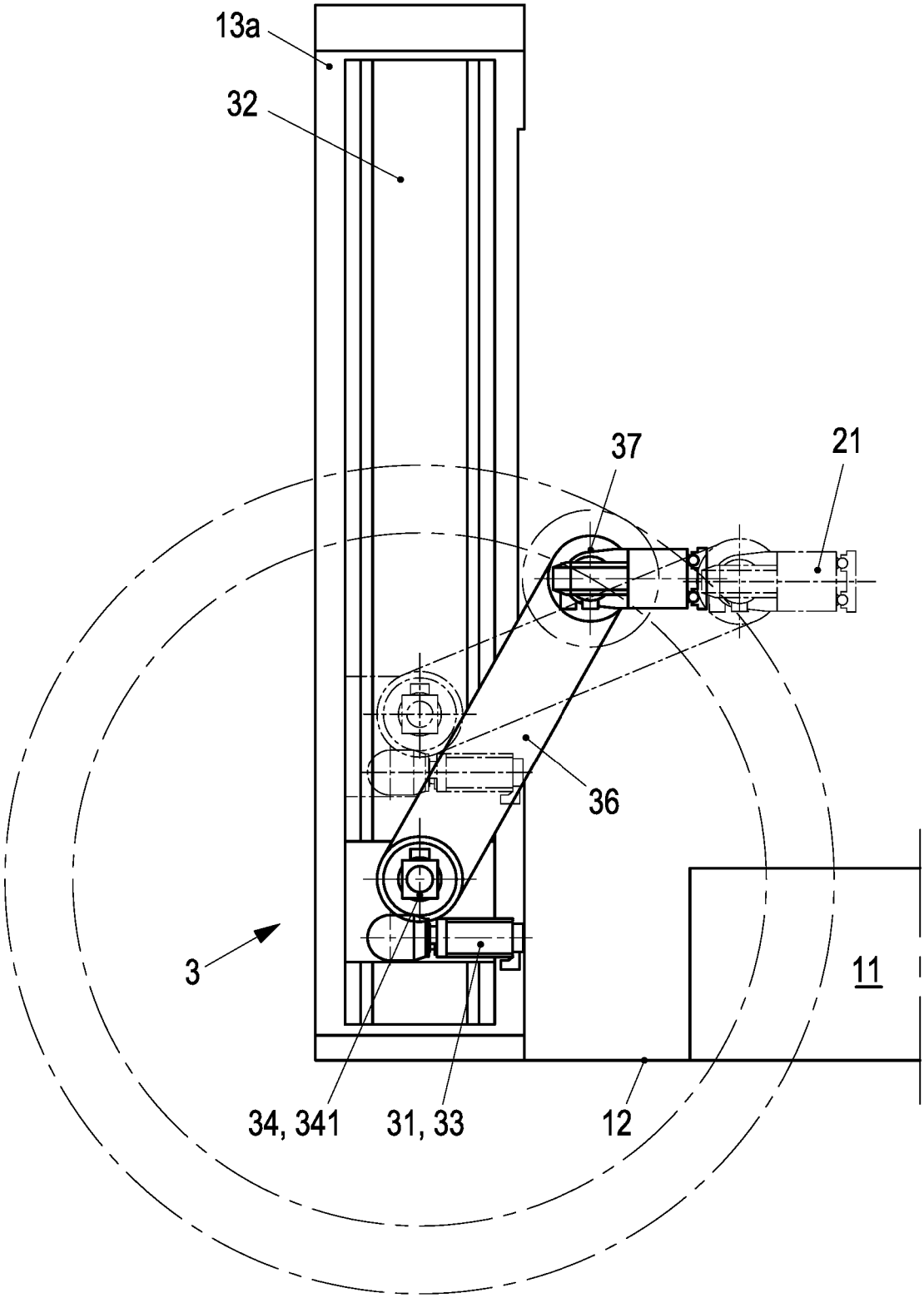
FIG. 5: a schematic representation of a turning circle of a lifting carriage.

The rocker 36 is rotatably mounted on the lifting carriage 3. Between the rocker 36 and the lifting carriage 3 a rotary drive 34 is arranged for this purpose, by means of which the rocker 36 can be rotated relative to the lifting carriage 3. The rotary drive 34 has a rotary motor 341, which can be formed as an electric servomotor or as a stepper motor. In FIG. 5, a turning area of a rotary drive 34 is represented by way of example.

At its end facing away from the lifting carriage 3, the rocker 36 is connected to a carrier rail via a bracket 38. In the area of the bracket, a longitudinal drive 39 is arranged, which drives the carrier rail in the longitudinal direction, i.e. in the workpiece transport direction W. Via the longitudinal drive 39, the carrier rail 21 or 22 can be moved in the workpiece transport direction W or contrary to the workpiece transport direction W.

The bracket 38 for connecting a carrier rail is optional. In one design not represented in the figures, the carrier rail can be secured directly, i.e. without an intermediary bracket, to the rocker.

The longitudinal drive 39 is also optional. In one design not represented in the figures, the carrier rail can be formed without a longitudinal drive. In this case, the carrier rail cannot be moved in the workpiece transport direction. A workpiece transport in the workpiece transport direction takes place in this case solely via the transport carriages.

Figure 2:
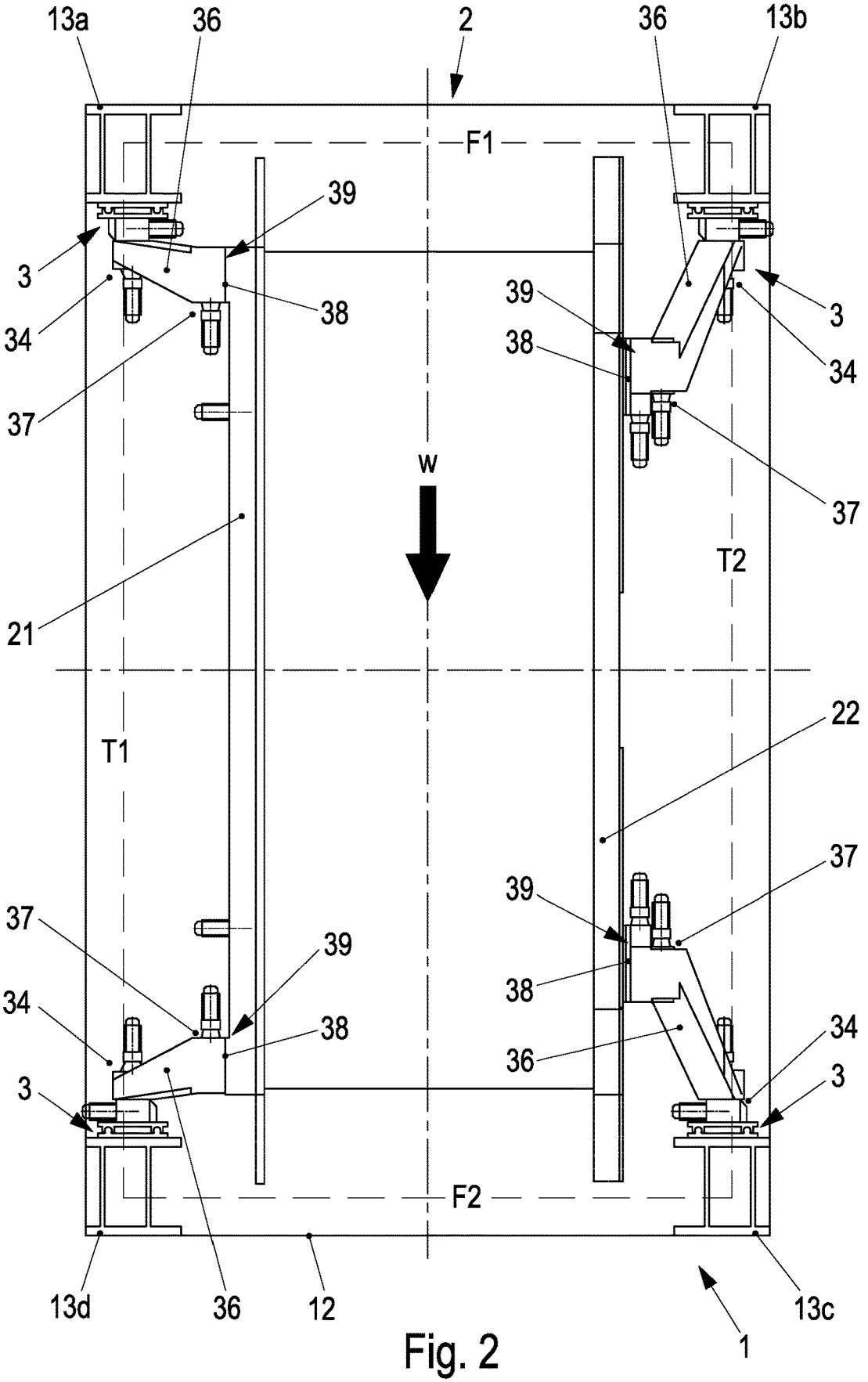
FIG. 2: a schematic top view of a variant of the press line with transport device.

In FIG. 2 a top view onto the press line 1 is represented. In this representation, the range of movement of the transport rails in the workpiece transport direction W is outlined. In the representation of FIG. 2, a press input window F1 is represented in the upper area. In this area, workpieces or raw material are transferred to the press line 1. For this purpose, the two carrier rails 21 and 22 each are moved via the longitudinal drive 39 contrary to the workpiece transport direction W with the result that they extend into the press input window F1. There, a workpiece or raw material can now be received via workpiece grippers 25.

As represented in FIGS. 1*a* and 1 *b*, the workpiece grippers 25 are movably mounted via transport carriages 24 on the carrier rails 21 and 22. This enables additional flexibility in that, not only can the carrier rails 21 and 22 be moved in the workpiece transport direction W, but in addition the transport carriages 24 and the workpiece grippers 25 respectively can also be moved in the workpiece transport direction W or contrary to the workpiece transport direction W, respectively.

In an alternative variant, which is not represented in the figures, it can be provided that the workpiece grippers are held directly on the carrier rail 21 or 22 via fixed holders. In this case, the workpiece transport takes place solely through the longitudinal drive 39 of the carrier rails 21 or 22.

After the workpieces have been received in the press input window F1, they are moved in the workpiece transport direction W into the pressing area. There, the workpiece can be processed. Subsequently, the workpiece can be moved via the longitudinal drive 39 and/or the transport carriages 24 into the output press window F2. In the output press window F2, the processed workpiece can be removed or supplied to a further processing station.

In the variants represented in FIGS. 1*a* and 1 *b*, with the transport carriages 24 movably mounted on the carrier rails 21 and 22, advantageously not only one workpiece can be taken over in the press input window F1. In addition, by selective actuation of the transport carriages 24, another workpiece can be taken over in the press output window F2. Subsequently, the transport carriages 24 can be moved, contrary to the workpiece transport direction W, into the pressing area together with the workpiece taken over in the press output window F2. This makes it possible for two workpieces to be processed in parallel in the pressing area. Alternatively, it can be provided that the two workpieces can be joined to each other in the pressing area. Subsequently, the workpieces can be transported out of the pressing area by actuating the transport carriages 24 in the workpiece transport direction and there removed or transferred to a further processing station.

The longitudinal drive 39 can be formed as an electric linear motor, as represented in FIG. 1*a*. The stator of the electric linear motor is arranged on the rocker 36 or a bracket 38. The rotor of the electric linear motor is arranged on the carrier rail 21 or 22, respectively and connected to the carrier rail and can be moved relative to the rocker 36 in the workpiece transport direction W.

In an alternative design, as represented in FIG. 1*a*, the longitudinal drive 39 can have a drive motor 391 cooperating with a toothed rack 392, in order to drive the carrier rails 21 or 22 in the workpiece transport direction W.

In an alternative design, the longitudinal drive can also have a toothed belt drive or a spindle drive.

In a simple design, the transport device 2 can also have carrier rails 21 and 22, which are connected directly, i.e. without a longitudinal drive 39, to the rocker 36. In this variant, the workpiece transport takes place solely via the individually actuatable transport carriages 24. During the transfer of workpieces or raw material in the area of the press window F1 or F2, in this variant, the workpieces are transported into the press window or transported out of the press window with a separate handling device.

The carrier rails 21 and 22 are pivotably connected to the rocker 36. In FIGS. 1*a*, 1*b* as well as in FIGS. 2, 3*a*, 3*b* and 5, a pivot drive 37 is provided on the end of the rocker 36 each, in order to pivot the carrier rail relative to the rocker. With the aid of this pivot drive 37, the carrier rail can be aligned relative to the rocker 36, for example be pivoted into a horizontally running position.

Figure 4B:
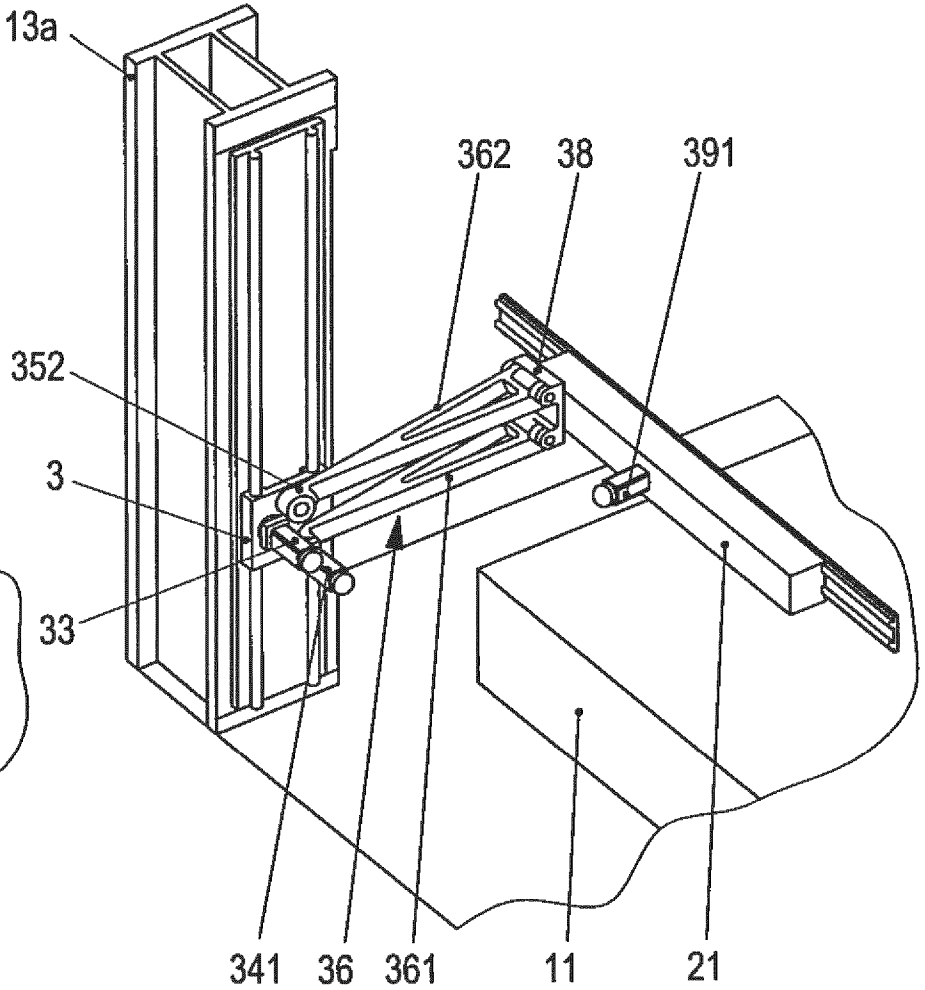
FIGS. 4*a*, 4*b*: a detailed representation of an alternative variant of the transport device in the area of a lifting carriage.
Figure 4A:
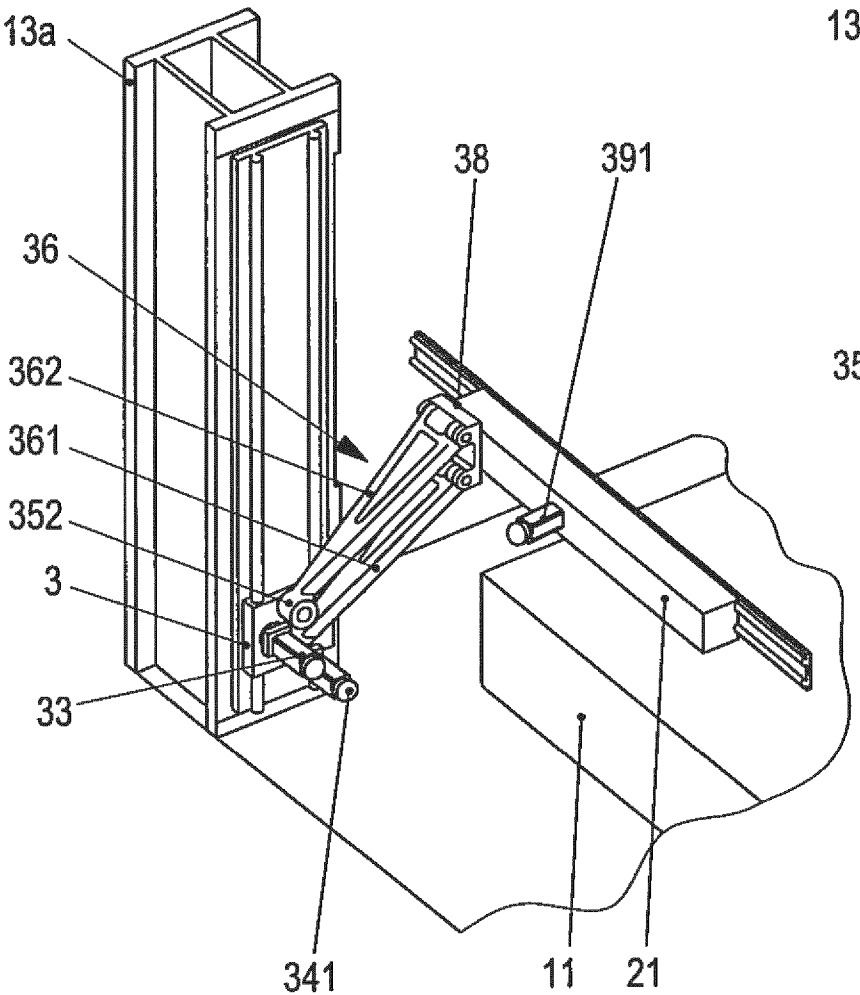

In FIGS. 4*a* and 4*b*, as well as 6*a* and 6*b*, an embodiment is shown in which the rocker 36 is formed as a parallel guide and has two rocker arms 361 and 362. Via this parallel guide, in this design the attached carrier rail 21 or 22 always has a horizontally running position.

The transport device 2 can move the carrier rails preferably in or contrary to the workpiece transport direction W, and transverse to the transport direction, i.e. in the clamping direction and vertically, i.e. in the lifting direction. A clamping movement, i.e. a movement transverse to the workpiece transport direction can take place through a combined actuation of the rotary drive 34 and the pivot drive 37 as follows. The rocker 36 is rotated via the rotary drive 34. Through the rotational movement, the carrier rail 21 or 22 realizes a first movement component transverse to the workpiece transport direction and a second movement component in the vertical direction. The movement component in the vertical direction is compensated by contrary actuation of the lifting carriage 3 with the result that the height of the carrier rail 21 or 22 remains unchanged. At the same time, the alignment of the carrier rail 21 or 22 is corrected via the pivot drive 37 or the parallel guide of the rocker 36 with the result that an alignment of the carrier rail 21 or 22 is not changed by the rotational movement. In this way, it is possible to perform a linear horizontal movement in the clamping direction with the carrier rails which are rotatably mounted via the rocker 36. The pivot drive 37, the rotary drive 34, as well as the lift drive 3 are actuated via a control device which is connected to the pivot drive 37, the rotary drive 34 and the lift drive 31 respectively.

Figure 3B:
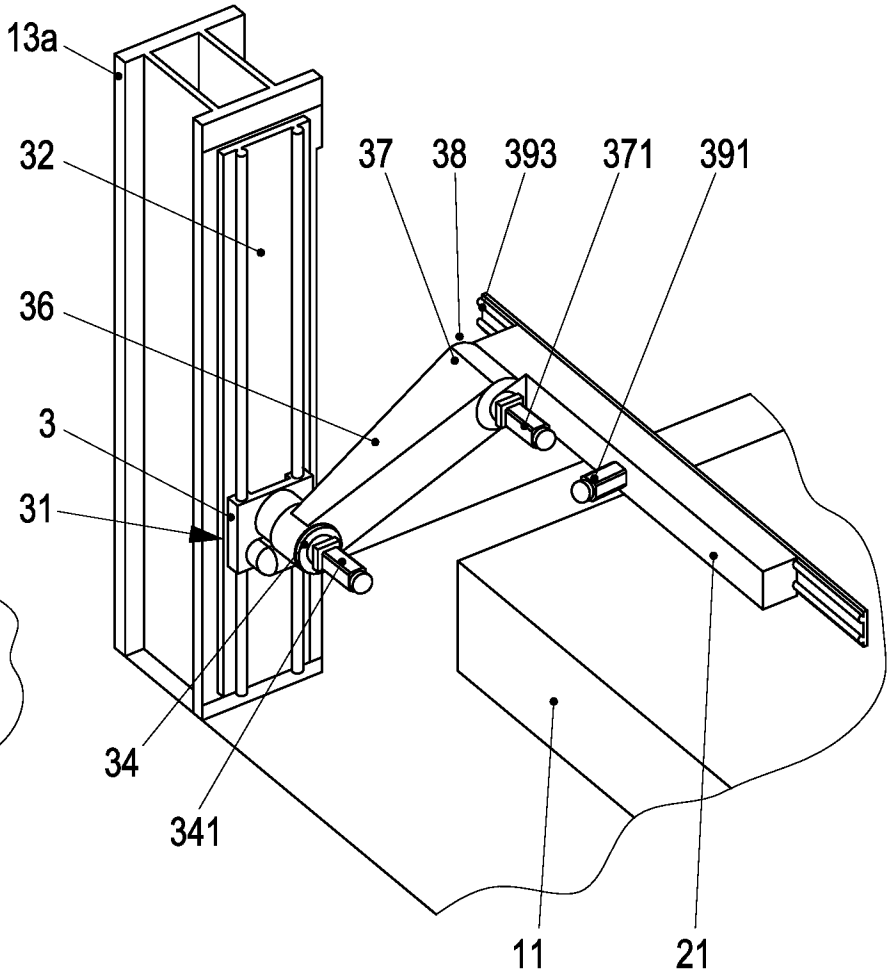
FIGS. 3*a*, 3*b*: a detailed representation of a variant of the transport device in the area of a lifting carriage.
Figure 3A:
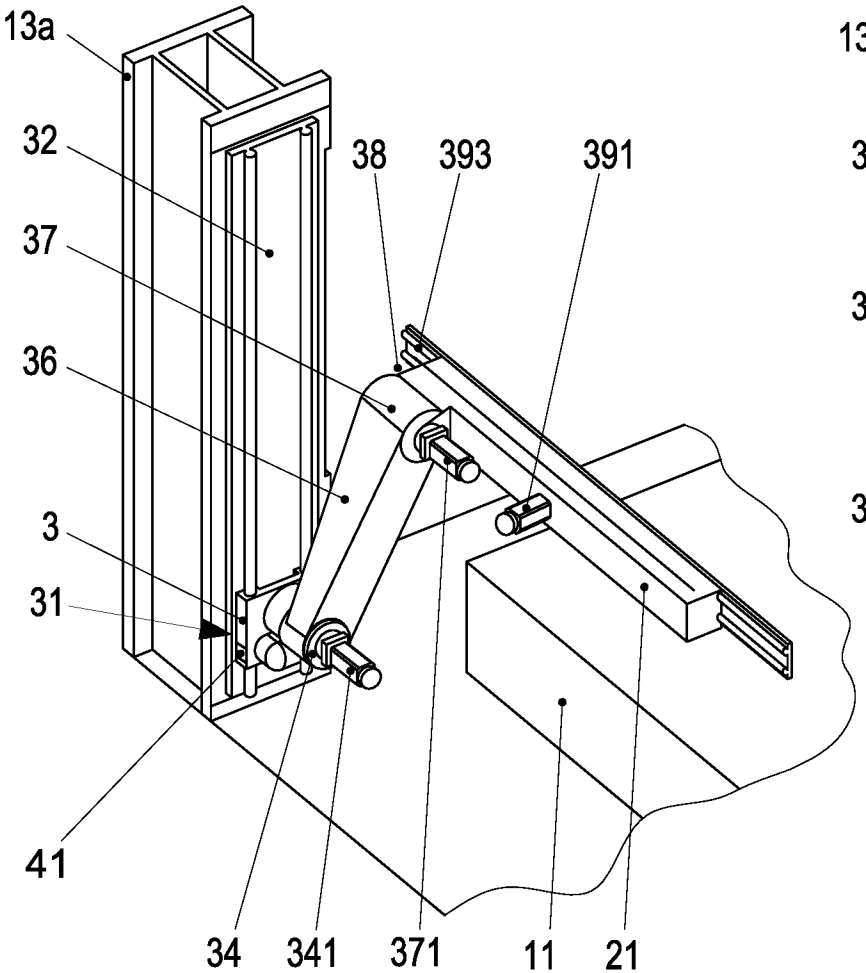

The rocker 36 rotatably mounted on the lifting carriage 3 can be formed, in a variant, as a one-piece rocker 36, as represented for example in FIGS. 3*a* and 3*b*. In this variant, the rocker 36 is rotatably connected to the lifting carriage 3 with one end via a pivot bearing. In the area of the pivot bearing, a rotary drive motor 341 of the rotary drive 34 is arranged, with the aid of which the rocker 36 can be rotated. On its other end, the rocker 36 has a pivot drive 37 with a pivot drive motor 371. The pivot drive motor 371 can be formed as an electric servomotor or as a stepper motor.

In the area of its end, the rocker 36 has a bracket 38 in order to detachably hold a carrier rail 21 or 22. The bracket 38 has a detachable mechanical holder, not shown, and an electrical plug connection. With the aid of the mechanical holder, a carrier rail 21 or 22 can be detachably secured to the bracket 38, for example screwed. Via the electrical plug connection, electrical power supply lines as well as control lines can be guided from the rocker to the carrier rail. Via the power supply lines, a power supply of the drive mechanisms 241 of the transport carriages 24 is ensured. Via control lines, the transport carriages 24 or the drive mechanisms 241 thereof can be selectively actuated. For this purpose, each drive mechanism 241 has an individual address, via which an electric linear motor 242 of the drive mechanism 241 can be selectively actuated. Both the speed and the drive direction of an individual drive mechanism 241 can be controlled in a targeted manner.

In FIGS. 4*a* and 4*b*, the transport device 2 is shown with an alternative design of the rocker 26 as parallel guide. The rocker 36 is formed in two parts, preferably as a parallelogram guide rod. This means, the rocker 36 has a first rocker arm 361 and a second rocker arm 362. The two rocker arms 361 and 362 are not directly connected to each other. One end of both rocker arms 361 and 362 is each rotatably mounted on the lifting carriage 3 via a pivot bearing 351 or 352, respectively. The first pivot bearing 351 has a rotary drive 34, in order to rotate the rocker 36 relative to the lifting carriage 3.

The rocker 36 has a bracket 38 at its end facing the carrier rail. The end of each rocker arm 361 and 362 is secured to the bracket 38 and mounted there rotatably. In this design of the rocker 36 consisting of two rocker arms 361 and 362, a pivot drive between bracket and carrier rail can be omitted. Because of the parallelogram linkage of the bracket 38 via the two rockers 361 and 362 which are offset with respect to each other in the vertical direction, it is automatically achieved, on rotating the rocker 36, that the bracket 38 remains in a horizontal alignment with the carrier rail. This emerges from the representation of FIGS. 4*a* and 4*b*, in which two different positions of the carrier rail 21 are represented. FIG. 4*b* shows the carrier rail in the maximum deflection in the clamping direction. In FIG. 4*a*, the carrier rail is arranged at the same vertical height but in the opened position, i.e. moved contrary to the clamping direction.

Figure 6B:
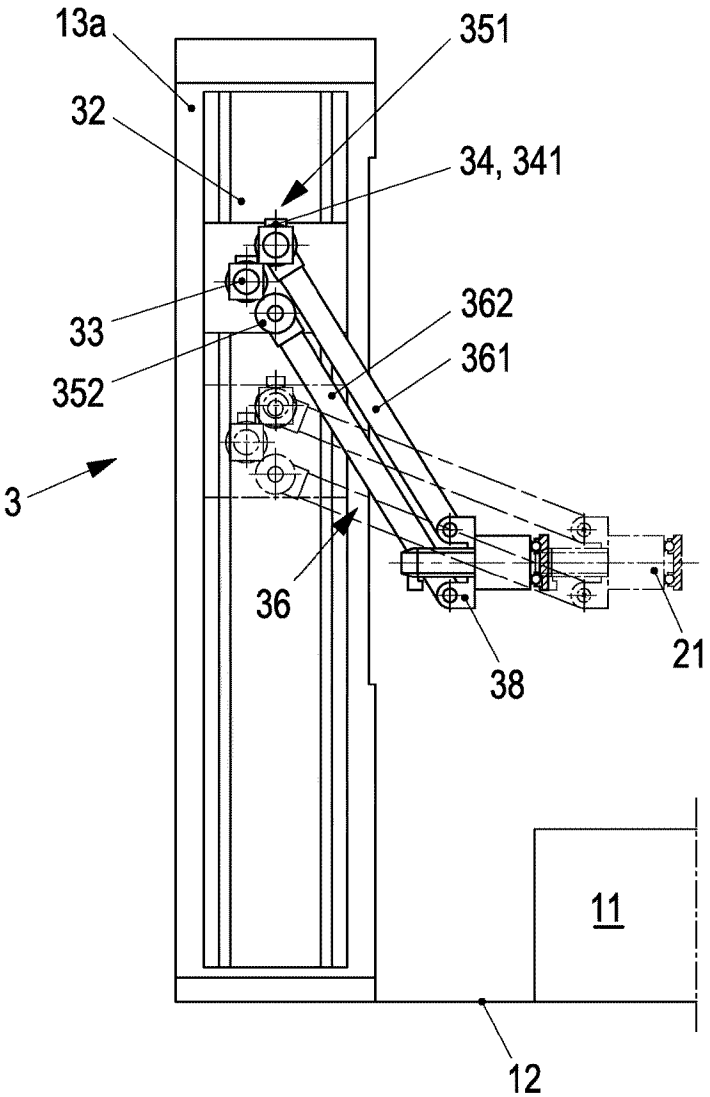
FIGS. 6*a*, 6*b*: a schematic representation of a lifting movement of a variant of the transport device in the area of a vertical press upright.
Figure 6A:
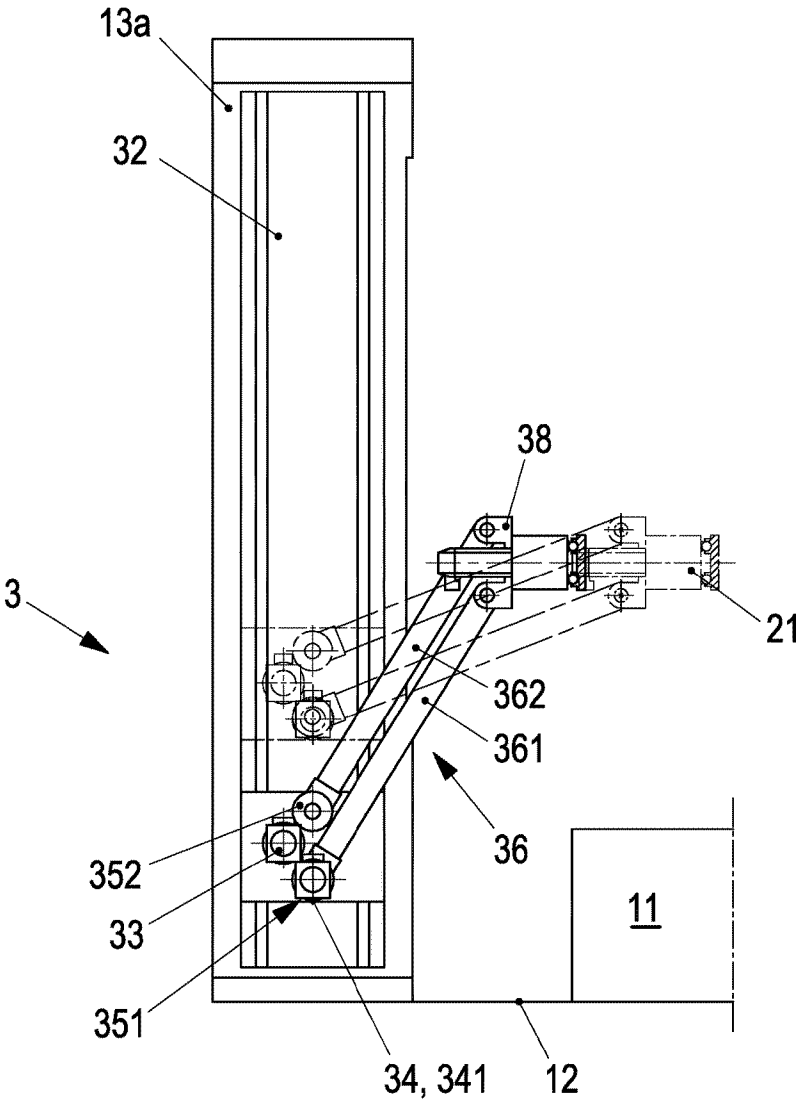

In the representations of FIGS. 6*a* and 6*b*, a further representation of the transport device is represented with a divided rocker 36. FIG. 6*a* shows the rocker 36 with a first rocker arm 361 and a second rocker arm 362, wherein the driven rocker arm 361 is arranged below the non-driven rocker arm 362 in the vertical direction. In the representation of FIG. 6*b* in contrast, the only difference is that the rocker 36 is formed in such a way that the non-driven second rocker arm 362 is arranged below the driven rocker arm 361 in the vertical direction.

The representation of FIG. 6*a* shows a variant of the actuation, in which the lifting carriage 3 is arranged below the carrier rails. The representation 6*b* shows a variant of the actuation, in which the lifting carriage 3 is arranged above the carrier rails. By utilizing the entire length of the lift rail 32, the position of the lifting carriage can thus be adapted to the respective space requirement. If the lower gate area is required for the workpiece transport, the position of the lifting carriage represented in FIG. 6*b* is used for the actuation. If, in contrast, the upper area of the press gate is required for the workpiece transport, the position of the lifting carriage 3 represented in FIG. 6*a* is used for the actuation.

In FIG. 5 the movement range of the rotary drive 34 is represented by way of example. The one-part rocker 36 can be pivoted through 360° via the rotary motor 341. Thereby, the carrier rail 21 or 22 respectively can be pivoted out of the pressing area through the gate area T. Outside the pressing area, adjustments or repair work can then be carried out on the carrier rails 21 or 22 and/or the transport carriages 24 and/or the workpiece grippers 25. Outside the pressing area means, at the same time, outside the danger area of the press. After carrying out the assembly work or adjustments, the carrier rail 21 or 22 respectively can then be moved back into the pressing area again via the rotary drive 24. In this way, the utilization of the installation space of the press line is optimized. No additional installation space needs to be provided within the pressing area in order to change tools. At the same time, it is not necessary for a technician to work inside the pressing area, i.e. inside the danger area of the press die, during maintenance work. Through the transport device according to the invention, a press line can thus be created which is constructed as compactly as possible and with which, at the same time, the safety during maintenance of the line is increased.

LIST OF REFERENCE NUMBERS

1 Press line
11 Press bed
12 Press base
13*a* Press upright
13*b* Press upright
13*c* Press upright
13*d* Press upright
T1, T2 Gate area
F1, F2 Press window
W Workpiece transport direction
2 Transport device
21 First carrier rail
22 Second carrier rail
24 Transport carriage
241 Drive mechanism
242 Electric linear motor
25 Workpiece gripper
3 Lifting carriage
31 Lift drive
32 Lift rail
33 Lifting motor
34 Rotary drive
341 Rotary motor
351 First pivot bearing
352 Second pivot bearing
36 Rocker
361 First rocker arm
362 Second rocker arm
37 Pivot drive
371 Pivot motor
38 Bracket
39 Longitudinal drive
391 Longitudinal drive motor
392 Toothed strip
393 Electric linear motor

The invention claimed is:

1. A transport device for transporting workpieces in a workpiece transport direction through a forming area in a forming machine or a pressing area of a press line, the transport device comprising a gate area arranged on a lateral side of the pressing area or forming area bordered by two vertical uprights having a carrier rail running in the workpiece transport direction, wherein each end of the carrier rail is mounted on one of the vertically running uprights, via a lifting carriage displaceably driven in the vertical direction by a lift drive, and the lifting carriage rotatably mounts a rocker, an end of the rocker being connected to the carrier rail, wherein the length of the carrier rail is shorter than the distance between the vertical uprights in the workpiece transport direction and the rocker is rotatably mounted on the lifting carriage in such a way that the carrier rail can be pivoted out of the pressing area or forming area in that the carrier rail can be pivoted between the two vertical uprights into the gate area or through the gate area.

2. The transport device according to claim 1, wherein the lifting carriage has a rotary drive for rotating the rocker and wherein the rotary drive has a rotary output which cooperates with a carriage-side pivot bearing for rotating the rocker.

3. The transport device according to claim 1, wherein the angle between the rocker and the vertical upright connected to the rocker is within an angular range of 0° to 10°, when the carrier rail is located in the gate area.

4. The transport device according to claim 1, wherein the carrier rail has a transport carriage with an exchangeable workpiece gripper.

5. The transport device according to claim 1, wherein, on the carrier rail, at least two transport carriages each having a workpiece gripper are mounted, wherein each transport carriage has a drive mechanism in order to move this transport carriage in a driven manner along the carrier rail independently of other transport carriages.

6. The transport device according to claim 1, wherein the rocker has a single rocker arm connecting the carrier rail to the lifting carriage, wherein the rocker arm is pivotably connected to the carrier rail.

7. The transport device according to claim 1, wherein the end of the rocker connected to the carrier rail has a bracket for the detachable connection of the carrier rail, wherein the bracket has a detachable mechanical connection and a detachable electrical connection.

8. The transport device according to claim 7, wherein the rocker has a pivot drive, which pivots the carrier rail and/or the bracket relative to the rocker in order to set a particular angle between the carrier rail and the rocker.

9. The transport device according to claim 7, wherein, on the end of the rocker connected to the carrier rail at the bracket, the rocker has a longitudinal drive in order to move the carrier rail in the workpiece transport direction.

10. The transport device according to claim 9, wherein the longitudinal drive is an electric linear motor having a stator arranged on the rocker or the bracket and a rotor arranged on the carrier rail, or wherein the rotor is arranged on the rocker or the bracket and the stator is arranged on the carrier rail.

11. The transport device according to claim 1, wherein the lift drive of the lifting carriage is formed as a linear motor.

12. The transport device according to claim 1, wherein the lifting carriage or the lift drive of the lifting carriage has a switchable locking mechanism in order to fix the lifting carriage in a vertical position on a vertical upright.

13. The transport device according to claim 1, wherein the lift drive and a rotary drive of the lifting carriage are connected to a control device and the control device is configured to actuate both the lift drive and the rotary drive for performing a clamping movement of the carrier rail.

14. The transport device according to claim 1, wherein the lift drive and a rotary drive and a pivot drive are connected to a control device and the control device is configured to actuate the lift drive as well as the rotary drive and the pivot drive for performing a clamping movement of the carrier rail.

15. The transport device according to claim 13, wherein the carrier rail has a longitudinal drive connected to the control device and the control device actuates the longitudinal drive for moving the carrier rail in the workpiece transport direction or contrary to the workpiece transport direction, in order to transport workpieces.

16. The transport device according to claim 1, wherein the vertical uprights are formed as press uprights.

17. The transport device according to claim 1, wherein two of the carrier rails running in the workpiece transport direction are provided, wherein each end of the two carrier rails is mounted on a respective one of the vertically running uprights via a respective one of the lifting carriages.

18. The transport device according to claim 1, wherein the lifting carriages are arranged in the lateral gate area, wherein one lifting carriage is mounted on a respective one of the vertical uprights each in such a way that the lifting carriages are arranged on the directly opposite ends of two vertical uprights.

19. A press line comprising a press bed and four press uprights, wherein two of the press uprights are arranged on one side of the press bed each, spaced apart from each other in the workpiece transport direction, and wherein wherein the press line further comprises a transport device according to claim 1 secured to the press uprights.

* * * * *